US011421478B2

(12) United States Patent
Herberg et al.

(10) Patent No.: US 11,421,478 B2
(45) Date of Patent: Aug. 23, 2022

(54) SUPPORT FEATURES FOR EXTENDABLE ELEMENTS OF A DOWNHOLE TOOL BODY, TOOL BODIES HAVING SUCH SUPPORT FEATURES AND RELATED METHODS

(71) Applicant: Baker Hughes Holdings LLC, Houston, TX (US)

(72) Inventors: Wolfgang E. Herberg, Niedersachsen (DE); Christopher Jakubeit, Langenhagen (DE); Michell Schimanski, Edemissen (DE)

(73) Assignee: Baker Hughes Holdings LLC, Houston, TX (US)

( * ) Notice: Subject to any disclaimer, the term of this patent is extended or adjusted under 35 U.S.C. 154(b) by 61 days.

(21) Appl. No.: 15/067,910

(22) Filed: Mar. 11, 2016

(65) Prior Publication Data

US 2017/0183914 A1 Jun. 29, 2017

Related U.S. Application Data

(60) Provisional application No. 62/271,710, filed on Dec. 28, 2015.

(51) Int. Cl.
*E21B 10/32* (2006.01)
*E21B 17/10* (2006.01)
*E21B 1/32* (2006.01)

(52) U.S. Cl.
CPC ..... *E21B 1/32* (2020.05); *E21B 17/1078* (2013.01)

(58) Field of Classification Search
CPC ..... E21B 10/32; E21B 17/1078
See application file for complete search history.

(56) References Cited

U.S. PATENT DOCUMENTS 1,764,373 A * 6/1930 Wells ..... E21B 10/325 175/283
3,729,057 A * 4/1973 Werner ..... E21B 4/00 175/262

(Continued)

FOREIGN PATENT DOCUMENTS

WO WO-2015084318 A2 * 6/2015 ..... E21B 17/1078

OTHER PUBLICATIONS

International Search Report for International Application No. PCT/US2016/068708 dated Apr. 14, 2017, 4 pages.

(Continued)

*Primary Examiner* — Christopher J Sebesta
*Assistant Examiner* — Neel Girish Patel
(74) *Attorney, Agent, or Firm* — TraskBritt

(57) ABSTRACT

An earth-boring tool includes a tool body configured to rotate in a wellbore and carrying at least one extendable element. The at least one extendable element is configured to move between a retracted position and an extended position projecting radially beyond the tool body. The at least one extendable element has a mating surface. The earth-boring tool includes a support structure located in the tool body and having a support surface that is located and configured to face the mating surface of the at least one extendable element when the at least one extendable element is in the extended position. The support surface of the support structure is configured to bear at least a portion of the tangential forces acting on the extendable element during rotation of the earth-boring tool in the wellbore when the at least one extendable element is in the extended position.

13 Claims, 4 Drawing Sheets

(56) References Cited

U.S. PATENT DOCUMENTS 3,757,877 A 9/1973 Leathers
4,662,461 A * 5/1987 Garrett ..... E21B 17/1078 175/325.4
6,837,314 B2 1/2005 Krueger et al.
7,036,611 B2 5/2006 Radford et al.
7,549,485 B2 6/2009 Radford et al.
7,681,666 B2 3/2010 Radford et al.
7,891,441 B2 2/2011 Lee
7,900,717 B2 * 3/2011 Radford ..... E21B 23/00 175/269
8,020,635 B2 9/2011 Radford
8,875,810 B2 11/2014 Meister et al.
8,960,328 B2 2/2015 Herberg et al.
9,051,792 B2 6/2015 Herberg et al.
9,689,213 B2 * 6/2017 Khaparde ..... E21B 17/1078
9,719,304 B2 * 8/2017 Radford ..... E21B 21/08
2003/0173115 A1 9/2003 Krueger et al.
2010/0089583 A1 * 4/2010 Xu ..... E21B 10/32 166/298
2010/0139981 A1 6/2010 Meister et al.
2010/0276201 A1 * 11/2010 Makkar ..... E21B 10/32 175/57
2011/0073371 A1 * 3/2011 Radford ..... E21B 10/322 175/57
2011/0127044 A1 * 6/2011 Radford ..... E21B 23/04 166/373
2012/0018173 A1 1/2012 Herberg et al.
2012/0055713 A1 3/2012 Herberg et al.
2012/0211280 A1 8/2012 Dewey et al.
2013/0133949 A1 * 5/2013 Xu ..... E21B 47/00 175/40
2013/0199855 A1 * 8/2013 Shears ..... E21B 10/32 175/270
2014/0110179 A1 * 4/2014 Lassoie ..... E21B 44/00 175/285
2014/0246236 A1 * 9/2014 Radford ..... E21B 47/13 175/40
2014/0262523 A1 * 9/2014 Davis ..... E21B 10/322 175/57
2015/0053484 A1 2/2015 Meister et al.
2015/0068813 A1 * 3/2015 Moreno, II ..... E21B 10/32 175/263
2015/0144401 A1 * 5/2015 Nagaraj ..... E21B 17/028 175/45
2015/0252630 A1 * 9/2015 Moyer ..... E21B 7/06 166/301
2016/0237762 A1 * 8/2016 Khaparde ..... E21B 7/067

OTHER PUBLICATIONS

International Written Opinion for International Application No. PCT/US2016/068708 dated Apr. 14, 2017, 5 pages.
GCC Examination Report for Application No. GC 2016-32609 dated Apr. 29, 2019, 4 pages.

* cited by examiner

SUPPORT FEATURES FOR EXTENDABLE ELEMENTS OF A DOWNHOLE TOOL BODY, TOOL BODIES HAVING SUCH SUPPORT FEATURES AND RELATED METHODS

CROSS-REFERENCE TO RELATED APPLICATION

This application claims the benefit of U.S. Provisional Patent Application Ser. No. 62/271,710, filed Dec. 28, 2015, the disclosure of which is hereby incorporated herein in its entirety by this reference.

TECHNICAL FIELD

The present disclosure relates generally to downhole tools having radially extendable elements and, more specifically, to radially extendable elements supported against rotational and tangential forces by a supporting feature secured to the downhole tool.

BACKGROUND

A variety of downhole tools employed in a subterranean earth-boring operation have extendable elements that engage or otherwise contact formation material within the wellbore. Such tools include expandable reamers, expandable stabilizers, steering modules, and steerable drilling liners, by way of non-liming example. Referring to reamers as an illustrative example, expandable reamers for enlarging a diameter of a wellbore include blades which are slidably, pivotably or hingedly coupled to a tubular body and actuated by way of hydraulic pressure, as non-limiting example. The blades of these currently available expandable reamers utilize pressure from inside the tubular body of the expandable reamer to force the blades, carrying cutting elements, radially outward to engage subterranean formation material on a wall of the wellbore. The blades in these expandable reamers are initially retracted to permit the expandable reamer to be run through the wellbore on a drill string and, once the expandable reamer is positioned at a desirable location within the wellbore (e.g., beyond the end of a casing or liner section), the blades are extended so the wellbore diameter below the casing or liner may be increased.

While reaming a wellbore, contact between the radially outermost portions of the blades and the formation material within the wellbore results in tangential forces on the blades in a direction opposite a direction of rotation of the reamer within the wellbore, which tangential forces press rotationally trailing portions of the blades against adjacent portions of the tubular body of the reamer, causing wear and degradation of the tubular body. The tangential forces on the blades also cause a bending moment on each of the blades, which also causes the blades to bear against the tubular body in deleterious fashion during a reaming operation. Such tangential forces and bending moments are encountered by most, if not all, extendable elements of downhole tools that contact or otherwise engage formation material within the wellbore.

BRIEF SUMMARY

This summary is provided to introduce a selection of concepts in a simplified form. These concepts are described in further detail in the detailed description of example embodiments of the disclosure below. This summary is not intended to identify key features or essential features of the claimed subject matter, nor is it intended to be used to limit the scope of the claimed subject matter.

In some embodiments, the present disclosure includes an earth-boring tool comprising a tool body configured to rotate in a wellbore and carrying at least one extendable element. The at least one extendable element is configured to move between a retracted position and an extended position projecting radially beyond the tool body. The at least one extendable element has a mating surface. The earth-boring tool includes a support structure located in the tool body and having a support surface that is located and configured to face the mating surface of the at least one extendable element when the at least one extendable element is in the extended position. The support surface of the support structure is configured to bear at least a portion of the tangential forces acting on the extendable element during rotation of the earth-boring tool in the wellbore when the at least one extendable element is in the extended position.

In additional embodiments, the present disclosure includes a method of preparing an expandable reamer for reaming a wellbore, in which the expandable reamer has a tool body. The method includes inserting a blade on a blade track formed in an opening in an outer surface of the tool body. The blade has a first end and a second end opposite the first end. The blade carries cutting elements and is configured to move on the blade track between a fully retracted position and a fully extended position. A mating structure is formed at the second end of the blade and includes a mating surface. The method includes securing a support structure to the tool body proximate an end of the opening at a location corresponding to the fully extended position of the blade. The support structure has a support surface formed in a recess formed in a blade-contacting end of the support structure. The support surface of the support structure is configured to be facing the mating surface of the blade when the blade is in the fully extended position.

In yet other embodiments, the present disclosure includes a blade of an expandable reamer apparatus. The blade includes a first end and a second end opposite the first end, with a longitudinal axis of the blade extending between the first and the second end. The blade is configured to move between a retracted position and an extended position relative to the tool body during a reaming operation. The blade includes a plurality of cutting elements facing a rotationally leading side of the blade between the first end and the second end. The blade also includes a mating structure at the second end of the blade. The mating structure includes a mating surface configured to mate with a support surface of an associated support structure that is secured to the tool body and configured to abut the second end of the blade when the blade is in the extended position.

BRIEF DESCRIPTION OF THE DRAWINGS

While the specification concludes with claims particularly pointing out and distinctly claiming what are regarded as embodiments of the present disclosure, the advantages of embodiments of the disclosure may be more readily ascertained from the description of certain examples of embodiments of the disclosure when read in conjunction with the accompanying drawings, in which:

DETAILED DESCRIPTION

The illustrations presented herein are not meant to be actual views of any particular earth-boring tool, extendable element, support structure, or device, but are merely idealized representations that are used to describe embodiments of the disclosure.

Any headings used herein should not be considered to limit the scope of embodiments of the present disclosure as defined by the appended claims and their legal equivalents. Concepts described in any specific headings are generally applicable in other sections throughout the entire specification.

When used herein in reference to a component configured to be located in a wellbore, the terms "above," "upper," "upward," "uphole" and "top" mean and include a relative position proximate the terranean origin of the well, whereas the terms "below," "lower," "downward," "downhole" and "bottom" mean and include a relative position distal the terranean origin of the well.

As used herein, the term "longitudinal" refers to a direction parallel to a longitudinal axis of a downhole tool or a longitudinal axis of a component thereof.

Figure 1:
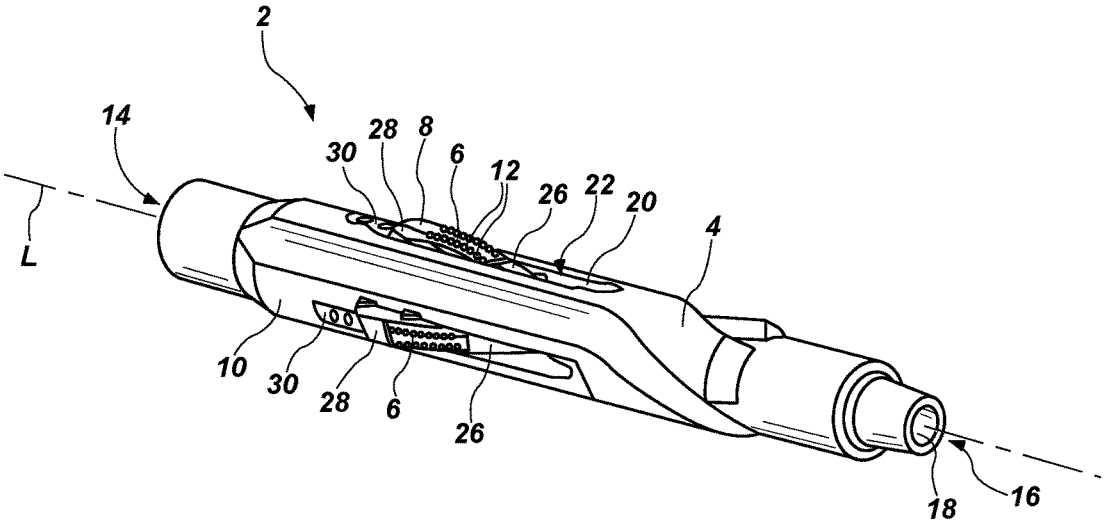
FIG. 1 illustrates a perspective view of an expandable reamer including a tool body having extendable blades disposed therein, according to an embodiment of the present disclosure.

As shown in FIG. 1, the earth-boring tool may be an expandable reamer 2 having a tool body 4 carrying a plurality of blades 6 that are extendable between a fully retracted position and a fully extended position. For example, in the fully retracted position, a radially outermost surface 8 of each of the blades 6 may be positioned radially inward of an outer surface 10 of the tool body 4. In the fully extended position, as shown in FIG. 1, the radially outermost surface 8 of each of the blades 6 may be positioned radially outward of the outer surface 10 of the tool body 4 so that cutting elements 12 carried by the blades 6 may engage subterranean formation material of the wall of a wellbore to enlarge a diameter of the wellbore. The blades 6 may also carry wear-resistant structures, such as hardfacing and/or inserts (not shown) with superabrasive material, by way of non-limiting example.

The tool body 4 may be an elongated tubular body having an upper end 14 and a lower end 16 with a longitudinal axis L extending therebetween. The tool body 4 may include an inner bore 18 extending longitudinally through the tool body 4 from the upper end 14 to the lower and 16 and defining a drilling fluid flow path extending longitudinally through the tool body 4. The blades 6 may be located in slots 20 formed in associated openings 22 in the outer surface 10 of the tool body 4.

Precise movement of the blades 6 between the fully retracted position and the fully extended position may be accomplished by any of a variety of actuation mechanisms, such as those more fully described in any of U.S. Pat. No. 8,020,635, issued Sep. 20, 2011, to Radford; U.S. Pat. No. 7,900,717, issued Mar. 8, 2011, to Radford et al.; U.S. Pat. No. 7,681,666, issued Mar. 23, 2010, to Radford et al.; U.S. Pat. No. 7,549,485, issued Jun. 23, 2009, to Radford et al.; and U.S. Pat. No. 7,036,611, issued May 2, 2006, to Radford et al., the entire disclosure of each of which is incorporated herein by this reference. By way of non-limiting example, a first, lower end 26 of each of the blades 6 may be operationally coupled to an actuation mechanism, such as a push sleeve (not shown) configured to move the blades 6 "upwardly" and radially outward from a retracted position to the fully extended position. It is to be appreciated that the blades 6 may be biased by one or more biasing elements to the fully retracted position, and the actuation mechanism may move the blades in a direction opposite the direction of a biasing force of the one or more biasing elements. When in the fully extended position, a second, upper end 28 of each blade 6 may abut against a support structure 30 secured to the tool body 4 in an upper end of the associated opening 22. As shown in FIG. 1, the support structure 30 may be a stop block, by way of non-limiting example. In this manner, the fully extended position of each blade 6 may be limited by the associated stop block 30. It is to be appreciated that the support structure 30 may comprise any structure configured to provide support against tangential forces imparted to the associated blade 6.

It is to be appreciated that the blades 6 of the tool body 4 may be configured to engage materials other than subterranean formation material within a wellbore. For example, in other embodiments, the blades 6 may be configured to engage an inner surface of a casing, a liner, a tube, or any other material within a wellbore. By way of non-limiting example, the tool body 4 may be a liner drive sub of a steerable drilling liner and the blades 6 may be configured to engage and drive the drilling liner.

Figure 2:
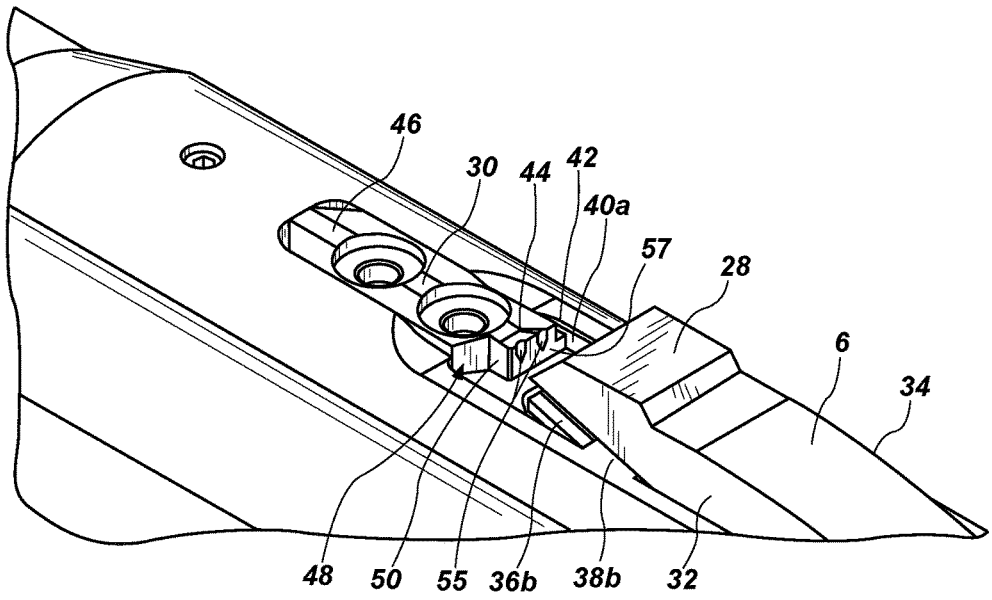
FIG. 2 illustrates a magnified perspective view of the tool body of FIG. 1, depicting an upper end of a blade and a lower end of a stop block, wherein the blade is near a fully extended position, according to an embodiment of the present disclosure.
Figure 3:
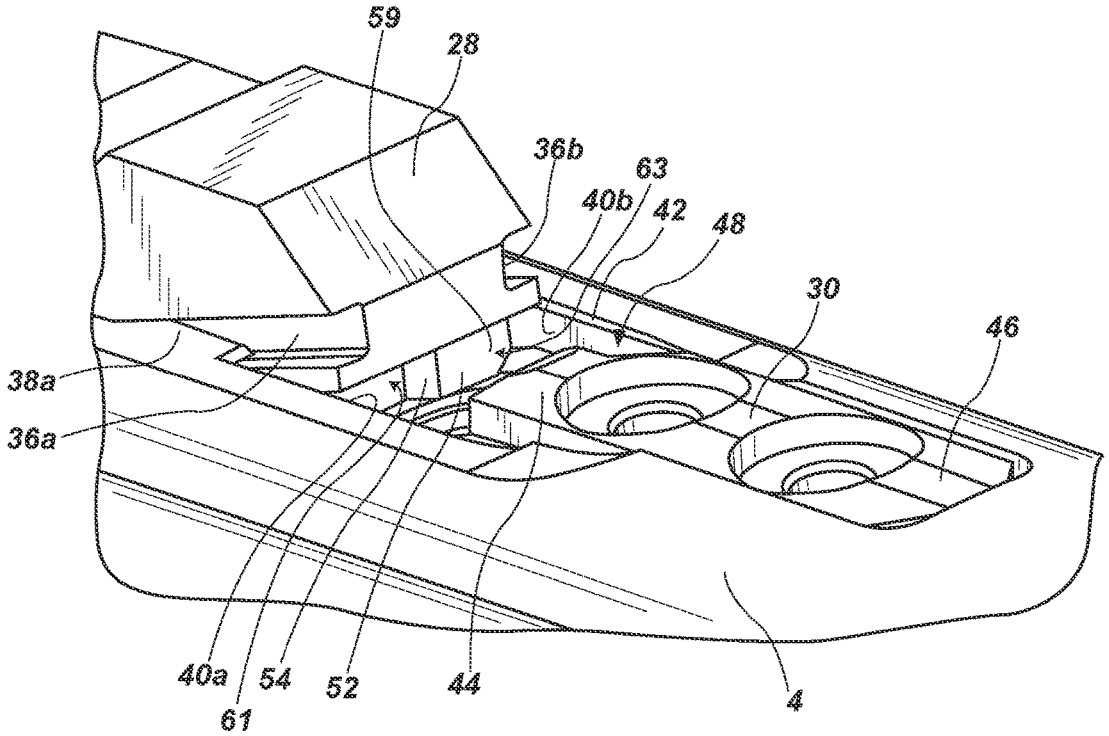
FIG. 3 illustrates a magnified perspective view of the tool body, the stop block and the upper end of the blade of FIG. 2, from a perspective opposite the perspective of FIG. 2.

Referring now to FIGS. 2 and 3, perspective views of the stop block 30 and an upper end 28 of a blade 6 of FIG. 1 are provided showing the blade 6 near the fully extended position. The blade 6 may include a rotationally leading side 32 and a rotationally trailing side 34 extending longitudinally from the upper end 28 to the lower end 26 (FIG. 1) of the blade 6. Blade tracks guide and support the blade 6 as the blade 6 moves between the fully retracted position and the fully extended position. The blade tracks are formed by recesses 36*a*, 36*b* and rails 38*a*, 38*b*. The blade tracks may be located within each of the slots 20 (FIG. 1), and each blade track may be oriented at an acute angle related to the longitudinal axis L of the tool body 4 (FIG. 1). The recesses 36*a*, 36*b* may be formed in each of the rotationally leading side 32 and the rotationally trailing side 34 of the blade 6, and may receive the corresponding rails 38*a*, 38*b* formed in opposing lateral sidewalls 40*a*, 40*b* of the tool body 4 within the slot 20. Movement of the blade 6 may be precisely controlled, as described above, to position the blade 6 along the recesses 36*a*, 36*b* and rails 38*a*, 38*b* to provide a specific reamed diameter of the wellbore. The maximum reamed diameter of the wellbore provided by the expandable reamer 2 (FIG. 1) may correspond to the fully extended position of the blades 6.

During a reaming operation, as the tool body 4 rotates and the cutting elements 12 (FIG. 1) on the blades 6 engage formation material of the wellbore sidewall, a reaction force is exerted on the cutting elements 12 in a direction generally tangential to the longitudinal axis L of the tool body 4, such that a tangential force is exerted on the blade 6 through the cutting elements 12 carried thereon. This tangential force on the blade 6 is borne by the rotationally trailing sidewall of the opposing lateral sidewalls 40*a*, 40*b* of the tool body 4 within the slot 20. This tangential force also imparts a bending moment on the blade 6, which bending moment is proportional to the radial extent to which the radial outermost surface 8 (FIG. 1) of the blade 6 extends from the tool body 4. The bending moment causes the blade 6 to bear against a radially outer edge 42 of the rotationally trailing sidewall 40*a* of the tool body 4 within the slot 20. Significant stresses result in the tool body 4 at the rotationally trailing sidewall 40*a* of the slot 20 and the radially outer edge 42 thereof. These stresses may result in wear and degradation of the tool body 4 at the rotationally trailing sidewall 40*a* and the radially outer edge 42 of the slot 20. To an extent, the rotationally trailing rail 38*a* formed in the rotationally trailing sidewall 40*a* of the slot 20 provides support for the blade 6 against the tangential forces and the bending moment exerted on the blade 6 during a reaming operation. However, resulting stresses in the rail 38*a* may also cause wear and degradation of the rail 38*a*, and may warp the rail 38*a* and deleteriously impede movement of the blade 6 between the fully retracted and the fully extended position.

As the tangential forces and the bending moment on the blade 6 are greatest when the blade 6 is in the fully extended position, additional supports for the blade 6 are provided that significantly reduce the extent to which the tangential forces and the bending moment are born by the tool body 4, thus preserving and extending the service life of the tool body 4. As the tool body 4 of the expandable reamer is typically significantly more expensive than the blades 6, extending the service life of the tool body 4 also results in significant cost savings. Additionally, the configuration described herein enables fast turn-around of the tool body after usage in a wellbore. In the event that the support structure shows significant wear after an operation in the wellbore, the support structure may be quickly and easily replaced, and replacement may be performed in the field at the rig site. Thus, significant non-productive time related to replacing the whole earth-boring tool in a bottom hole assembly may be reduced or even eliminated.

At least one of the aforementioned additional support surfaces may be formed on the stop block 30 secured to the tool body 4 in the upper end of the opening 22 (FIG. 1). The stop block 30 may include a lower, blade end 44 and an upper, opposite end 46 located opposite the blade end 44. The lower, blade end 44 may also be termed a "first end" of the stop block 30, and the upper, opposite end 46 may also be termed a "second end" of the stop block 30. The blade end 44 of the stop block 30 may be configured to matingly engage at least a portion of the upper end 28 of the associated blade 6 when the blade 6 is at or near the fully extended position. The blade end 44 of the stop block 30 may include a recess 48 defining a support surface 50 (FIG. 2) generally facing a rotationally forward direction (i.e., generally facing the direction of rotation of the tool body 4 in a wellbore during an earth-boring operation). The recess 48 may be sized and configured to receive a mating structure 52 (FIG. 3), formed at the upper end 28 of the blade 6, when the blade 6 is in the fully extended position. As shown in FIG. 3, the mating structure 52 of the upper end 28 of the blade 6 may include a mating surface 54 oriented substantially parallel with the support surface 50 at the blade end 44 of the stop block 30. The mating surface 54 may extend generally longitudinally downward (i.e., in a generally downhole direction) from the upper end 28 of the blade 6. In this manner, when the blade 6 is in the fully extended position, the mating structure 52 at the upper end 28 of the blade 6 may generally fit within the recess 48 in the blade end 44 of the stop block 30 and the upper end 28 of the blade 6 may overhang the blade end 44 of the stop block 30 such that an uppermost cutting element of the blade 6 is positioned substantially directly radially outward of the mating surface 54 and the support surface 50 (as illustrated more clearly in FIG. 5).

With continued reference to FIGS. 2 and 3, when the blade 6 is in the fully extended position, the mating surface 54 at the upper end 28 of the blade 6 may be located adjacent to and facing the support surface 50 at the blade end 44 of the stop block 30. One or both of the mating surface 54 and the support surface 50 may optionally have grooves (not shown) formed therein to allow for passage of drilling fluid and formation cuttings therethrough to prevent formation cuttings from being lodged between the mating surface 54 and the support surface 50 and disrupting movement of the blade 6 at or near the fully extended position. Grooves 55 may also be formed in a lowermost end surface 57 (FIG. 2) of the stop block 30 for allowing circulation of drilling fluid and passage of formation cuttings therethrough when the blade 6 is at or near the fully extended position. When the blade 6 is in the fully extended position, the lowermost end surface 57 of the stop block 30 may abut an uppermost end 59 (FIG. 3) of the mating structure 52 of the upper end 28 of the blade 6. However, in other embodiments, a gap may be present between the lowermost end surface 57 of the stop block 30 and the uppermost end 59 of the mating structure 52 when the blade 6 is in the fully extended position.

One or both of a lower edge of the support surface 50 and an upper edge of the mating surface 54 may be chamfered or rounded to facilitate upward longitudinal movement of the mating structure 52 past the lower edge of the support surface 50 as the blade 6 moves into the fully extended position. The recess 48 in the blade end 44 of the stop block 30 and the mating structure 52 at the upper end 28 of the blade 6 may each be sized and configured such that the mating surface 54 of the blade 6 and the support surface 50 of the stop block 30 abut one another when the blade 6 is the fully extended position, although, in other embodiments, a narrow gap (not shown) may exist between the support surface 50 and the mating surface 54. In such embodiments, the gap between the support surface 50 and the mating surface 54 may be narrower than a gap between the rotationally trailing side 34 of the blade 6 and the rotationally trailing sidewall 40*a* of the tool body 4 within the slot 20.

Figure 4:
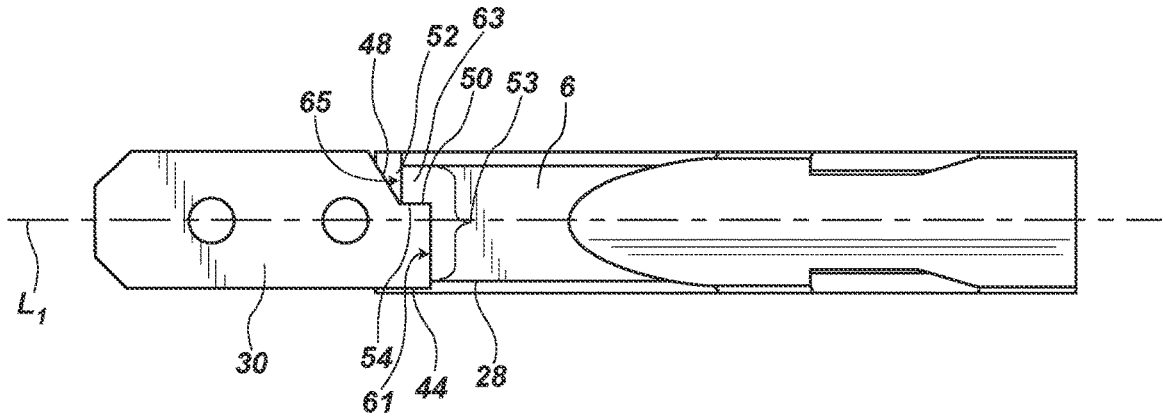
FIG. 4 illustrates a bottom view of the stop block and a partial bottom view of the blade of FIGS. 1 through 3, with the blade shown in the fully extended position, and a mating structure of the upper end of the blade received within a recess formed in the lower end of the stop block.

FIG. 4 is a bottom view of the stop block 30 and the reamer blade 6 of FIGS. 2 and 3 with the blade 6 shown in the fully extended position such that the mating structure 52 of the upper end 28 of the blade 6 is received within the recess 48 at the blade-end 44 of the stop block 30. The support surface 50 at the blade end 44 of the stop block 30 and the mating surface 54 at the upper end 28 of the blade 6 may each be oriented substantially parallel with the longitudinal axis $L_1$ of the blade 6 and the stop block 30. In some embodiments, the support surface 50 and the mating surface 54 may each be oriented substantially parallel with the longitudinal axis L of the tool body 4. As shown, the recess 48 at the blade-end 44 of the stop block 30 and the mating structure 52 at the upper end 28 of the blade 6 may be cooperatively sized and configured to provide a generally conformal fit between the recess 48 and the mating structure 52.

Figure 5:
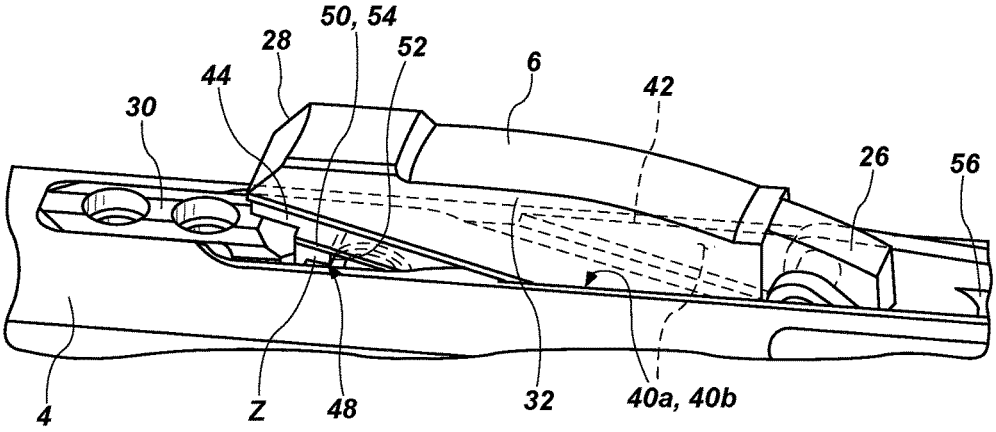
FIG. 5 illustrates a perspective view of the blade, the stop block and a portion of the tool body of FIGS. 1 through 3, with a transparent view of the blade shown in the fully extended position, according to an embodiment of the present disclosure.

Referring now to FIG. 5, a perspective view of the rotationally leading side 32 of the blade 6 is shown (with a transparent view of the blade 6 provided) with the blade 6 in the fully extended position. Because the mating surface 54 at the upper end 28 of the blade 6 may extend generally longitudinally downward from the upper end 28 of the blade 6, allowing the upper end 28 of the blade 6 to overhang the blade end 44 of the stop block 30, the view of each of the mating structure 52 and the mating surface 54 at the upper end 28 of the blade 6 and the recess 48 and the support surface 50 at the blade end 44 of the stop block 30 would be obstructed by the upper end 28 of the blade 6 if a non-transparent view of the blade 6 were provided in FIG. 5. The mating surface 54 (facing away from the field of view in FIG. 5) at the upper end 28 of the blade 6 and the support surface 50 (facing toward the field of view in FIG. 5) at the blade-end 44 of the stop block 30, as indicated by dashed outline Z, may be correspondingly sized and shaped. A magnified view of the mating surface 54 of the upper end 28 of the blade 6 mating with the support surface 50 of the stop block 30 is provided in FIG. 6. As the cutting elements 12 (FIG. 1) carried by the blade 6 engage subterranean formation material and tangential forces are imparted to the blade 6 through the cutting elements 12, the upper end 28 of the blade 6 bears primarily against the support surface 50 of the stop block 30 instead of bearing directly against the rotationally trailing sidewall 40*a* and the radially outer edge 42 thereof during a reaming operation. When the stop block 30 or the blade 6 become worn or damaged due to exposure to the tangential forces imparted to the blade and the stop block 30, as previously described, the stop block 30 and/or the blade 6 may be replaced without need for replacing or repairing the tool body 4.

Figure 6:
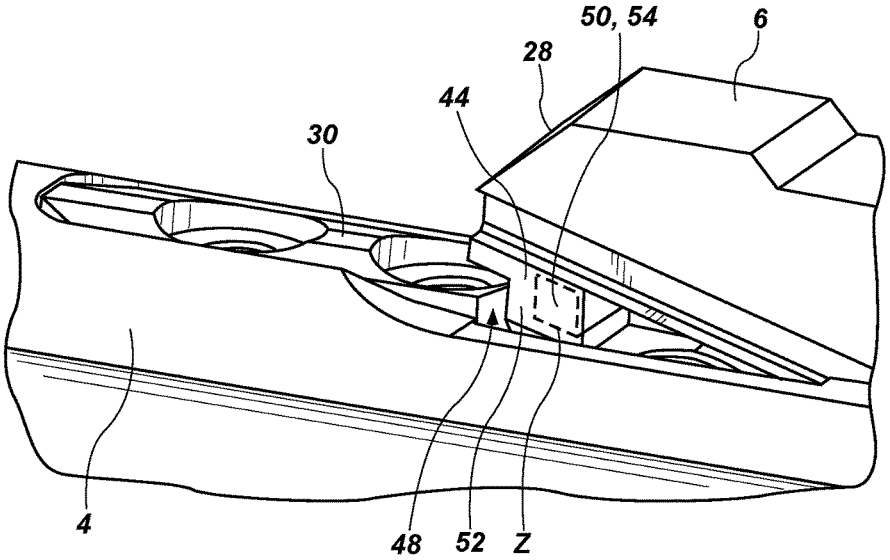
FIG. 6 illustrates a magnified perspective view of the upper end of the blade and the lower end of the stop block shown in FIG. 5.
Figure 7:
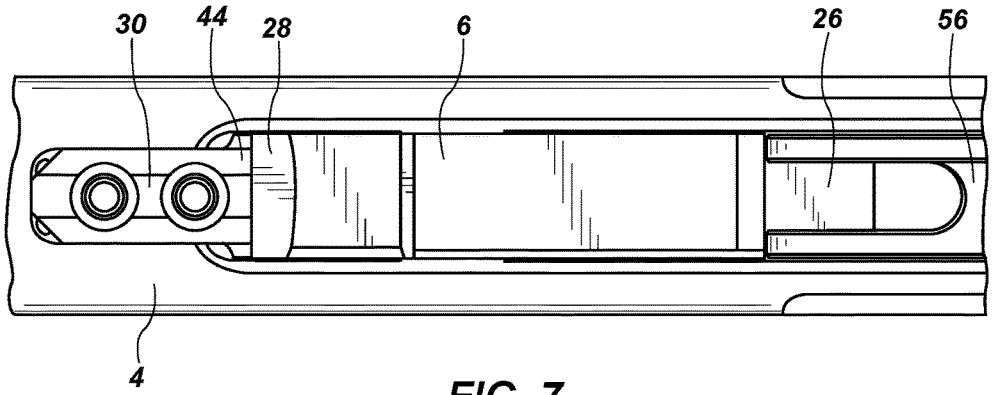
FIG. 7 illustrates a top view of the blade and the stop block of FIGS. 1 through 6 positioned on the tool body, with the blade in the fully extended position.

As an additional view of reference, FIG. 7 illustrates a top view of the blade 6 and the stop block 30 shown in FIGS. 1 through 6. As shown, a linking mechanism 56 may couple the lower end 26 of the blade 6 to the actuation mechanism (not shown) for moving the blade 6 along the blade track defined by the recesses 36*a*, 36*b* and rails 38*a*, 38*b* (FIGS. 3, 5 and 6) between the fully retracted position and the fully extended position.

Figure 8:
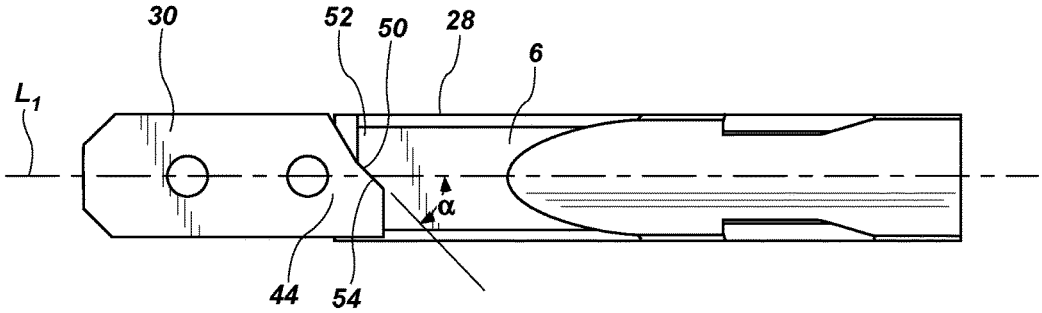
FIG. 8 illustrates a bottom view of a stop block and a partial bottom view of a blade of the expandable reamer with the blade in the fully extended position, wherein a support surface of the lower end of the stop block and a mating surface of a mating structure of the blade are each oriented at an angle of about 45 degrees from a longitudinal axis of the blade, according to an embodiment of the present disclosure.

Referring now to FIG. 8, an additional embodiment of the stop block 30 and the blade 6 is shown, similar to that shown in FIG. 4, with the primary difference being that the support surface 50 of the stop block 30 and the mating surface 54 of the blade 6 are each oriented at a relief angle $\alpha$ of about 45 degrees from a longitudinal axis $L_1$ of each of the stop block 30 and the blade 6. The relief angle $\alpha$ may facilitate insertion of the mating structure 52 of the upper end 28 of the blade 6 into the recess 48 of the blade end 44 of the stop block. It is to be appreciated that the support surface 50 of the stop block 30 and the mating surface 54 of the blade 6 may each be oriented at any suitable relief angle that allows movement of the mating structure 52 of the blade 6 into the recess 48 of the stop block 30. For example, in other embodiments, the support surface 50 and the mating surface 54 may each be oriented at a relief angle $\alpha$ between about 0 degrees and about 10 degrees from the longitudinal axis $L_1$ of each of the stop block 30 and the blade 6. In yet other embodiments, the support surface 50 and the mating surface 54 may each be oriented at a relief angle $\alpha$ between about 10 degrees and about 20 degrees from the longitudinal axis $L_1$ of each of the stop block 30 and the blade 6. In additional embodiments, the support surface 50 and the mating surface 54 may each be oriented at a relief angle $\alpha$ between about 20 degrees and about 30 degrees from the longitudinal axis $L_1$ of each of the stop block 30 and the blade 6. In further embodiments, the support surface 50 and the mating surface 54 may each be oriented at a relief angle $\alpha$ between about 30 degrees and about 50 degrees from the longitudinal axis $L_1$ of each of the stop block 30 and the blade 6. In yet further embodiments, the support surface 50 and the mating surface 54 may each be oriented at a relief angle $\alpha$ of about 50 degrees or greater from the longitudinal axis $L_1$ of each of the stop block 30 and the blade 6.

Figure 9:
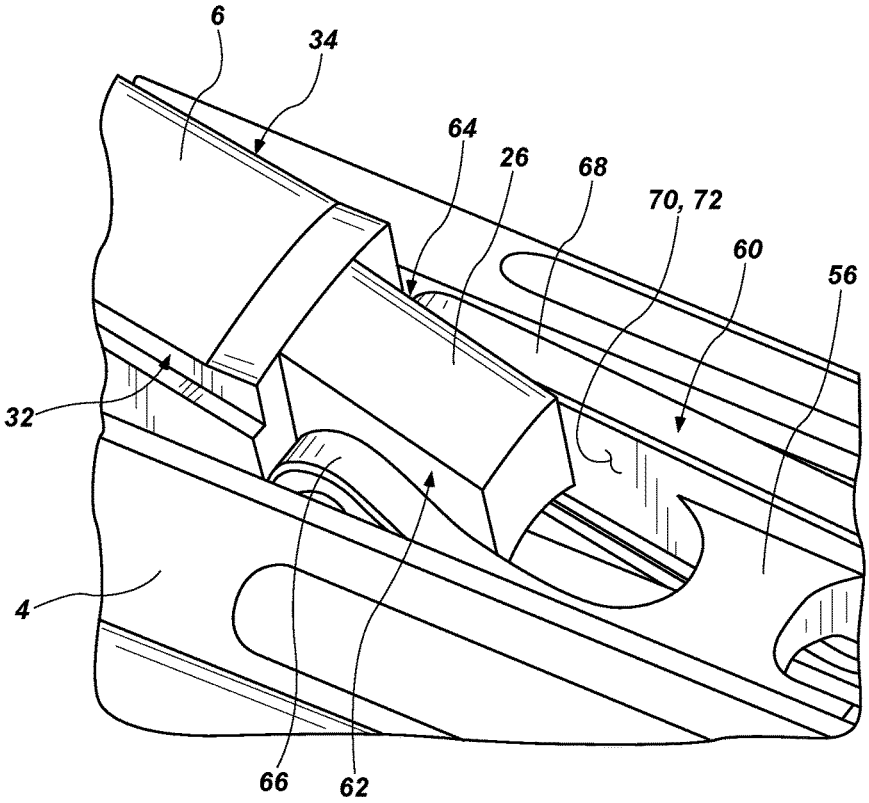
FIG. 9 illustrates a perspective view of a lower end of the expandable reamer blade of FIGS. 1 through 8 coupled to a linking mechanism, according to an embodiment of the present disclosure.

FIG. 9 illustrates a perspective view of the lower end 26 of the blade 6 having a receiving formation formed thereon for receiving bracket arms of an upper end 60 of the linking mechanism 56 shown in FIG. 6. The receiving formation at the lower end 26 of the blade 6 may include a first recessed surface 62 formed on the rotationally leading side 32 of the blade 6 and a second recessed surface 64 formed on the rotationally trailing side 34 of the blade 6. Each of the first recessed surface 62 and the second recessed surface 64 of the lower end 26 of the blade 6 may be recessed at a depth from the respective surfaces of the rotationally leading side 32 and the rotationally trailing side 34 of the blade 6 substantially equivalent to a lateral width of the associated bracket arm received therein. For example, a rotationally leading bracket arm 66 may be received laterally adjacent the first recessed surface 62 of the lower end 26 of the blade 6 and a rotationally trailing bracket arm 68 may be received laterally adjacent the second recessed surface 64 of the lower end 26 of the blade 6, wherein a lateral span between the first and second recessed surfaces 62, 64 of the lower end 26 of the blade 6 is bracketed between the bracket arms 66, 68 of the linking mechanism 56. While not visible in FIG. 9, it is to be appreciated that a pin may be inserted laterally through the bracket arms 66 and 68 of the linking mechanism 56 and through an associated bore extending laterally through the lateral span between the first and second recessed surfaces 62, 64 of the lower end 26 of the blade 6, pivotably coupling the lower end 26 of the blade 6 to the linking mechanism 56.

An inner lateral sidewall 70 of the rotationally trailing bracket arm 68 may be generally planar and may be configured to substantially abut the second recessed surface 64 on the rotationally trailing side 34 of the lower end 26 of the blade 6. In this manner, the inner lateral sidewall 70 of the rotationally trailing bracket arm 68 may form a second support surface 72 and may bear the tangential forces and bending moment imparted to the lower end 26 of the blade 6 similar to the manner in which the support surface 50 of the stop block 30 bears the tangential forces and bending moment of the upper end 28 of the blade 6. Additionally, as with the support surface 50 at the blade end 44 of the stop block 30 described above, the inner lateral sidewall 70 of the rotationally trailing bracket arm 68 may significantly reduce the extent to which the tangential forces and the bending moment exerted on the blade 6 are born by the tool body 4. When the linking mechanism 56, or the bracket arms 66, 68 thereof, become worn or damaged during use, the linking mechanism 56 may be removed and replaced by a new or refurbished linking mechanism of similar design instead of requiring expensive repairs to or replacement of the tool body 4. For example, a method of repairing or refurbishing the expandable reamer 2 disclosed herein may include uncoupling and removing one or more of the stop blocks 30 from the tool body, uncoupling one or more of the blades 6 from their associated linking mechanisms 56, removing the one or more blades 6 from the tool body 4, removing any worn or damaged linking mechanisms, and replacing any worn or damaged linking mechanisms 56, blades 6, or stop blocks 30 with new or refurbished components.

It is to be appreciated that the design characteristics of the support surface 50 of the stop block 30 and the associated mating surface 54 of the upper end 28 of the blade 6, as well as the second support surface 72 of the linking mechanism 56 and the associated second recessed surface 64 of the lower end 26 of the blade 6, may be incorporated on other downhole tools or components with radially extendible elements. For example, the tool body 4, the stop block 30 and the linking mechanism 56 disclosed herein may be utilized with an extendable bearing pad, such as a stabilizer or steering pad (not shown) employed in place of the blade 6. The extendable bearing pad may have an upper end with a mating structure configured generally similar to the mating structure 52 of the blade 6 for mating with the support surface 50 of the stop block 30, as previously described. In such an embodiment, the extendable bearing pad may have a lower end with a receiving formation configured generally similar to the first and second recessed surfaces 62, 64 for receiving the bracket arms 66, 68 of the linking mechanism, as previously described. The foregoing design characteristics may also be incorporated on other downhole tools with extensible elements, including steering modules or steerable drilling liners, by way of non-limiting example. It is to be appreciated that any downhole tool with extendable elements for contacting a sidewall of a wellbore may employ one or more mating surfaces in connection with a stop block or linking mechanism with one or more associated support surfaces in the manner previously described herein.

Additional non-limiting example embodiments of the present disclosure are set forth below.

Embodiment 1

An earth-boring tool, comprising: a tool body configured to rotate in a wellbore; at least one extendable element carried by the tool body, the at least one extendable element configured to move between a retracted position and an extended position projecting radially beyond the tool body, the at least one extendable element having a mating surface; and a support structure secured to the tool body, the support structure having a support surface located and configured to mate with the mating surface of the at least one extendable element when the at least one extendable element is in the extended position, wherein the support surface of the support structure is configured to bear at least a portion of the tangential forces acting on the extendable element during rotation of the earth-boring tool in the wellbore when the at least one extendable element is in the extended position.

Embodiment 2

The earth-boring tool of Embodiment 1, wherein the support structure comprises at least a portion of a stop block removably secured to the tool body.

Embodiment 3

The earth-boring tool of Embodiment 1 or Embodiment 2, wherein the mating surface and the support surface are oriented substantially parallel to one another.

Embodiment 4

The earth-boring tool of any one of Embodiments 1 through 3, wherein the support surface is located within a recess formed in a first end of the support structure.

Embodiment 5

The earth-boring tool of Embodiment 4, wherein the mating surface of the at least one extendable element is located on a mating structure of the at least one extendable element, the mating structure configured to fit within the recess formed in the first end of the support structure.

Embodiment 6

The earth-boring tool of Embodiment 5, wherein at least a portion of each of the mating surface and the support surface are oriented substantially parallel to a longitudinal axis of the tool body.

Embodiment 7

The earth boring tool of Embodiment 5 or Embodiment 6, wherein at least a portion of each of the mating surface and the support surface are oriented at an angle relative to the longitudinal axis of the tool body.

Embodiment 8

The earth-boring tool of any one of Embodiments 1 through 7, wherein the at least one extendable element has a first end operatively coupled to an actuation mechanism configured to move the at least one extendable element between the retracted position and the extended position.

Embodiment 9

The earth-boring tool of Embodiment 8, wherein the at least one extendable element has a second end opposite the first end, the mating structure of the at least one extendable element is located at the second end of the at least one extendable element on an underside of the at least one extendable element.

Embodiment 10

The earth-boring tool of Embodiment 9, wherein a portion of the second end of the at least one extendable element overhangs the mating surface of the at least one extendable element and the support surface of the support structure when the at last one extendable element is in a fully extended position.

Embodiment 11

The earth-boring tool of any one of Embodiments 8 through 10, further comprising a linking mechanism coupling the first end of the at least one extendable element to the actuation mechanism.

Embodiment 12

The earth-boring tool of Embodiment 11, wherein the linking mechanism comprises at least two bracket arms bracketing the first end of the at least one extendable element, a pin extending laterally through the at least two bracket arms and the first end of the at least one extendable element, the pin pivotally coupling the first end of the at least one extendable element to the linking mechanism.

Embodiment 13

The earth-boring tool of Embodiment 12, wherein the at least two bracket arms comprise a rotationally leading bracket arm and a rotationally trailing bracket arm, an inner lateral surface of the rotationally trailing bracket arm received against a lateral recessed surface of the first end of the at least one extendable element on a rotationally trailing side of the at least one extendable element.

Embodiment 14

The earth-boring tool of Embodiment 13, wherein the lateral recessed surface of the first end of the at least one extendable element is configured to bear against the inner lateral surface of the rotationally trailing bracket arm of the linking mechanism, and tangential forces imparted to the first end of the at least one extendable element responsive to rotation of the earth-boring tool are born by the inner lateral surface of the rotationally trailing bracket arm.

Embodiment 15

The earth-boring tool of any one of Embodiments 1 through 14, wherein the at least one extendable element is a reamer blade carrying a plurality of cutting elements thereon.

Embodiment 16

The earth-boring tool of Embodiment 15, wherein the reamer blade is configured to move between the retracted position and the extended position on a blade track formed in the tool body, the blade track oriented at an acute angle relative to a longitudinal axis of the tool body.

Embodiment 17

The earth-boring tool of any one of Embodiments 1 through 16, wherein the at least one extendable element comprises an extendable bearing pad.

Embodiment 18

A method of preparing an expandable reamer for reaming a wellbore, the expandable reamer having a tool body, the method comprising: inserting a blade on a blade track formed in an opening in an outer surface of a tool body, the blade having a first end and a second end opposite the first end, the blade carrying cutting elements, the blade configured to move on the blade track between a fully retracted position and a fully extended position, a mating structure formed at the second end of the blade, the mating structure comprising a mating surface; and securing a support structure to the tool body proximate an end of the opening at a location corresponding to the fully extended position of the blade, the support structure having a support surface formed in a recess formed in a blade end of the support structure, the support surface of the support structure configured to be mate with the mating surface of the blade when the blade is in the fully extended position.

Embodiment 19

The method of Embodiment 18, wherein securing the support structure to the tool body comprises removing a previously used support structure from the tool body prior to securing the support structure to the tool body, the support structure having at least substantially the same configuration as the previously used support structure.

Embodiment 20

A blade of an expandable reamer apparatus, comprising: a first end and a second end opposite the first end, a longitudinal axis of the blade extending between the first and the second end, the blade configured to move between a retracted position and an extended position relative to a tool body during a reaming operation; a plurality of cutting elements facing a rotationally leading side of the blade between the first end and the second end; a mating structure at the second end of the blade, the mating structure comprising a mating surface, the mating surface configured to mate with a support surface of an associated support structure secured to the tool body and configured to abut the second end of the blade when the blade is in the extended position.

Embodiment 1A

An earth-boring tool, comprising: a tool body 4 configured to rotate in a wellbore; at least one extendable element carried by the tool body 4, the at least one extendable element configured to move between a retracted position and an extended position projecting radially beyond the tool body 4, the at least one extendable element comprising a mating structure 52 formed at an upper end of the extendable element, the mating structure 52 comprising: a stepped structure 53 comprising: a base surface 61 to which a longitudinal axis of the at least one extendable element is normal; a step 63 formed to one lateral side of the upper end of the extendable element, projecting from the base surface 61, and having an upper surface 65, the stepped structure 53 ascending along a direction perpendicular to the longitudinal axis of the at least one extendable element and a mating surface 54 extending between the base surface 61 of the stepped structure 53 and the upper surface 65 of the step 63; and a support structure 30 secured to the tool body 4, the support structure 30 comprising a recess 48 configured to receive the step 63 of the stepped structure 53 of the mating structure 52, the recess 48 defining a support surface 50 facing a rotationally forward direction of the earth-boring tool and configured to abut against the mating surface 54 of the stepped structure 53 of the mating structure 52 of the at least one extendable element when the at least one extendable element is in the extended position.

Embodiment 2A

The earth-boring tool of embodiment 1A, wherein the support structure 30 comprises at least a portion of a stop block removably secured to the tool body 4.

Embodiment 3A

The earth-boring tool of embodiment 1A, wherein the at least one extendable element has a first end operatively coupled to an actuation mechanism configured to move the at least one extendable element between the retracted position and the extended position.

Embodiment 4A

The earth-boring tool of embodiment 3A, wherein the at least one extendable element has a second end opposite the first end, the mating structure 52 of the at least one extendable element is located at the second end of the at least one extendable element on an underside of the at least one extendable element.

Embodiment 5A

The earth-boring tool of embodiment 3A, further comprising a linking mechanism 56 coupling the first end of the at least one extendable element to the actuation mechanism.

Embodiment 6A

The earth-boring tool of embodiment 5A, wherein the linking mechanism comprises at least two bracket arms 66, 68 bracketing the first end of the at least one extendable element, a pin extending laterally through the at least two bracket arms 66, 68 and the first end of the at least one extendable element, the pin pivotally coupling the first end of the at least one extendable element to the linking mechanism 56.

Embodiment 7A

The earth-boring tool of embodiment 6A, wherein the at least two bracket arms 66, 68 comprise a rotationally leading bracket arm 66 and a rotationally trailing bracket arm 68, an inner lateral surface of the rotationally trailing bracket arm 68 received against a lateral recessed surface of the first end of the at least one extendable element on a rotationally trailing side of the at least one extendable element.

Embodiment 8A

The earth-boring tool of embodiment 7A, wherein the lateral recessed surface of the first end of the at least one extendable element is configured to bear against the inner lateral surface of the rotationally trailing bracket arm 68 of the linking mechanism 56, and tangential forces imparted to the first end of the at least one extendable element responsive to rotation of the earth-boring tool are born by the inner lateral surface of the rotationally trailing bracket arm 68.

Embodiment 9A

The earth-boring tool of embodiment 1A, wherein the at least one extendable element is a reamer blade carrying a plurality of cutting elements 12 thereon.

Embodiment 10A

The earth-boring tool of claim 9A, wherein the reamer blade is configured to move between the retracted position and the extended position on a blade track formed in the tool body 4, the blade track oriented at an acute angle relative to a longitudinal axis of the tool body 4.

Embodiment 11A

The earth-boring tool of embodiment 1, wherein the at least one extendable element comprises an extendable bearing pad.

Embodiment 12A

A blade 6 of an expandable reamer apparatus 2, comprising: a first end and a second end opposite the first end, a longitudinal axis of the blade extending between the first and the second end, the blade 6 configured to move between a retracted position and an extended position relative to a tool body 4 during a reaming operation; a plurality of cutting elements 12 facing a rotationally leading side of the blade 6 between the first end and the second end; and a mating structure 52 formed at the second end of the blade 6, the mating structure 52 comprising: a stepped structure 53 comprising: a base surface 61 having a base surface component to which a longitudinal axis of the at least one extendable element is normal; a step 63 formed to one lateral side of the upper end of the extendable element, projecting from the base surface 61, and having an upper surface 65, the stepped structure 53 ascending along a direction having a direction component that is perpendicular to the longitudinal axis of the at least one extendable element; and a mating surface 54 extending between the base surface 61 of the stepped structure 53 and the upper surface 65 of the step 63.

Embodiment 13A

The earth-boring tool of embodiment 1A, wherein the support surface 50 of the support structure 30 extends in a direction perpendicular to a longitudinal end surface of the support structure 30, the longitudinal end surface of the support structure 30 configured to abut against a correlating surface of the at least one extendable element when the at least one extendable element is in the extended position.

While certain illustrative embodiments have been described in connection with the figures, those of ordinary skill in the art will recognize and appreciate that embodiments of the present disclosure are not limited to those embodiments explicitly shown and described herein. Rather, many additions, deletions, and modifications to the embodiments described herein may be made without departing from the scope of embodiments of the present disclosure as hereinafter claimed, including legal equivalents. In addition, features from one disclosed embodiment may be combined with features of another disclosed embodiment while still being encompassed within the scope of embodiments of the present disclosure as contemplated by the applicants.

What is claimed is:

1. An earth-boring tool, comprising:

a tool body configured to rotate in a wellbore;

at least one extendable element carried by the tool body, the at least one extendable element configured to move between a retracted position and an extended position projecting radially beyond the tool body, the at least one extendable element comprising a mating structure formed at an upper end of the extendable element, the mating structure comprising:

a stepped structure comprising:

a base surface to which a longitudinal axis of the at least one extendable element is normal;

a step formed to one lateral side of the upper end of the extendable element, projecting from the base surface, and having an upper surface, the stepped structure ascending along a direction perpendicular to the longitudinal axis of the at least one extendable element; and a mating surface extending between the base surface of the stepped structure and the upper surface of the step; and a support structure secured to the tool body, the support structure comprising a recess configured to receive the step of the stepped structure of the mating structure, the recess defining a support surface facing a rotationally forward direction of the earth-boring tool and configured to abut against the mating surface of the stepped structure of the mating structure of the at least one extendable element when the at least one extendable element is in the extended position.

2. The earth-boring tool of claim 1, wherein the support structure comprises at least a portion of a stop block removably secured to the tool body.

3. The earth-boring tool of claim 1, wherein the at least one extendable element has a first end operatively coupled to an actuation mechanism configured to move the at least one extendable element between the retracted position and the extended position.

4. The earth-boring tool of claim 3, wherein the at least one extendable element has a second end opposite the first end, the mating structure of the at least one extendable element is located at the second end of the at least one extendable element on an underside of the at least one extendable element.

5. The earth-boring tool of claim 3, further comprising a linking mechanism coupling the first end of the at least one extendable element to the actuation mechanism.

6. The earth-boring tool of claim 5, wherein the linking mechanism comprises at least two bracket arms bracketing the first end of the at least one extendable element, a pin extending laterally through the at least two bracket arms and the first end of the at least one extendable element, the pin pivotally coupling the first end of the at least one extendable element to the linking mechanism.

7. The earth-boring tool of claim 6, wherein the at least two bracket arms comprise a rotationally leading bracket arm and a rotationally trailing bracket arm, an inner lateral surface of the rotationally trailing bracket arm received against a lateral recessed surface of the first end of the at least one extendable element on a rotationally trailing side of the at least one extendable element.

8. The earth-boring tool of claim 7, wherein the lateral recessed surface of the first end of the at least one extendable element is configured to bear against the inner lateral surface of the rotationally trailing bracket arm of the linking mechanism, and tangential forces imparted to the first end of the at least one extendable element responsive to rotation of the earth-boring tool are born by the inner lateral surface of the rotationally trailing bracket arm.

9. The earth-boring tool of claim 1, wherein the at least one extendable element is a reamer blade carrying a plurality of cutting elements thereon.

10. The earth-boring tool of claim 9, wherein the reamer blade is configured to move between the retracted position and the extended position on a blade track formed in the tool body, the blade track oriented at an acute angle relative to a longitudinal axis of the tool body.

11. The earth-boring tool of claim 1, wherein the at least one extendable element comprises an extendable bearing pad.

12. The earth-boring tool of claim 1, wherein the support surface of the support structure extends in a direction perpendicular to a longitudinal end surface of the support structure, the longitudinal end surface of the support structure configured to abut against a correlating surface of the at least one extendable element when the at least one extendable element is in the extended position.

13. A blade of an expandable reamer apparatus, comprising:

a first end and a second end opposite the first end, a longitudinal axis of the blade extending between the first and the second end, the blade configured to move between a retracted position and an extended position relative to a tool body during a reaming operation;

a plurality of cutting elements facing a rotationally leading side of the blade between the first end and the second end; and a mating structure formed at the second end of the blade, the mating structure comprising:

a stepped structure comprising:

a base surface having a base surface component to which a longitudinal axis of the blade is normal;

a step formed to one lateral side of an upper end of the blade, projecting from the base surface, and having an upper surface, the stepped structure ascending along a direction having a direction component that is perpendicular to the longitudinal axis of the at least one extendable element; and a mating surface extending between the base surface of the stepped structure and the upper surface of the step.

* * * * *